US009624056B2

(12) United States Patent
Yamamoto

(10) Patent No.: US 9,624,056 B2
(45) Date of Patent: Apr. 18, 2017

(54) SHEET FEEDING APPARATUS AND IMAGE FORMING APPARATUS

(71) Applicant: CANON KABUSHIKI KAISHA, Tokyo (JP)

(72) Inventor: Shinkichi Yamamoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/882,802

(22) Filed: Oct. 14, 2015

(65) Prior Publication Data

US 2016/0107852 A1 Apr. 21, 2016

(30) Foreign Application Priority Data

Oct. 17, 2014 (JP) ..... 2014-212434

(51) Int. Cl.

| | |
|---|---|
| ***B65H 9/16*** | (2006.01) |
| ***B65H 3/68*** | (2006.01) |
| ***B65H 1/04*** | (2006.01) |
| ***B65H 5/36*** | (2006.01) |
| ***B65H 1/26*** | (2006.01) |
| ***B65H 5/38*** | (2006.01) |

(52) U.S. Cl.

CPC ..... *B65H 5/36* (2013.01); *B65H 1/04* (2013.01); *B65H 1/266* (2013.01); *B65H 3/68* (2013.01); *B65H 5/38* (2013.01); *B65H 9/166* (2013.01); *B65H 2402/61* (2013.01); *B65H 2404/742* (2013.01); *B65H 2405/114* (2013.01)

(58) Field of Classification Search

CPC ..... B65H 9/166; B65H 1/04; B65H 1/266; B65H 3/68

See application file for complete search history.

(56) References Cited

U.S. PATENT DOCUMENTS

| | | | | |
|---|---|---|---|---|
| 4,329,589 A * | 5/1982 | Stievenart | G03B 42/025 198/345.3 |
| 5,149,080 A | 9/1992 | Yamamoto | |
| 5,284,333 A * | 2/1994 | Ishikawa | B65H 9/166 271/22 |
| 5,348,287 A | 9/1994 | Yamamoto et al. | |
| 5,507,482 A * | 4/1996 | Tenpaku | B65H 9/166 271/251 |
| 5,588,758 A | 12/1996 | Yamamoto | |

(Continued)

FOREIGN PATENT DOCUMENTS

| | | |
|---|---|---|
| JP | 06-92475 A | 4/1994 |
| JP | 2006347731 A * | 12/2006 |

*Primary Examiner* — Luis A Gonzalez

(74) *Attorney, Agent, or Firm* — Fitzpatrick, Cella, Harper & Scinto

(57) ABSTRACT

A sheet feeding apparatus includes a conveyance guide member provided in an apparatus body and having a reference plane against which a sheet widthwise side edge orthogonal to a sheet feeding direction abuts. The reference plane is provided upstream in the feed direction of a downstream end in the feed direction of the sheet stacked on the stacking member in a state in which the sheet feed cassette is attached to the attachment position of the apparatus body and is provided under, in terms of a vertical direction, an uppermost sheet stacked on the stacking member in the state in which the sheet feed cassette is attached to the attachment position of the apparatus body.

6 Claims, 5 Drawing Sheets

(56) References Cited

U.S. PATENT DOCUMENTS

| | | | | |
|---|---|---|---|---|
| 5,593,152 | A * | 1/1997 | Wirth | B65H 1/266 271/162 |
| 5,642,949 | A | 7/1997 | Yamamoto | |
| 5,651,540 | A | 7/1997 | Watanabe et al. | |
| 2012/0003024 | A1 | 1/2012 | Kaiga et al. | |

* cited by examiner

SHEET FEEDING APPARATUS AND IMAGE FORMING APPARATUS

BACKGROUND OF THE INVENTION

Field of the Invention

The present invention relates to a sheet feeding apparatus positioning a sheet by making a widthwise side edge of the sheet orthogonal to a sheet feeding direction abut against a reference plane and to an image forming apparatus such as a copier, a printer, a facsimile, and others including the same.

Description of the Related Art

A sheet must be supplied to an image forming portion in a condition in which position of the sheet is straightened in order to form an image on a correct position of the sheet in an image forming apparatus such as a copier, a printer, a facsimile, and others. Then, there is known a configuration of making a widthwise side edge of the sheet, on which an image is to be formed, abut against a reference plane as one of configurations of positioning the widthwise edge orthogonal to a sheet feeding direction.

For instance, Japanese Patent Application Laid-open No. Hei.06-92475 discloses a configuration of forming the reference plane against which the sheet widthwise side edge is made abut by making a reference plane provided on a side of a sheet feed cassette to be attached to the apparatus body in flush with a reference plane provided on an apparatus body side.

Specifically, according to Japanese Patent Application Laid-open No. Hei.06-92475, a reference plate within the apparatus body is provided with an inclined surface formed at a lower end portion thereof. The inclined surface is directed to a center side of the apparatus body. Still further, a reference guide formed in the sheet feed cassette on the downstream side of the sheet feed cassette is held by a holding member and includes a project portion projecting above the holding member. An inclined surface facing outside of the sheet feed cassette is formed on the project portion and the inclined surface is located at a position abuttable with an inclined surface of the reference plate of the apparatus body. The sheet feed cassette is biased to a reference plate side on the apparatus body side by a bias portion such as a side spring in a condition in which the sheet feed cassette is attached to the apparatus body. Accordingly, in response to the attachment of the sheet feed cassette to the apparatus body, the inclined surface of the reference guide of the sheet feed cassette is brought into pressure contact with, as if it is drawn into, the inclined surface of the reference plate of the apparatus body. Thereby, the reference plane of the reference guide is position to be flush with the reference plane of the reference plate.

Still as another method, according to Japanese Patent Application Laid-open No. Hei.06-92475, a positioning plate of the reference plate provided in the apparatus body is formed by bending a lower end portion of the reference plate. Still further, a groove including an opening provided in the sheet feed cassette is formed in the holding member whose upper surface is on a same level with the reference guide. This arrangement makes it possible to position the reference plane of the reference plate on the apparatus body side in flush with the reference plane of the reference guide on the sheet feed cassette side when the sheet feed cassette is attached to the apparatus body.

Conventionally, the reference plane on the apparatus body side is made in flush with the reference plane on the sheet feed cassette side by constructing as described above.

However, a downsized and quick-printing speed image forming apparatus is demanded in the recent market. In order to attain such demands, it is necessary to shorten a distance for conveying a sheet from the sheet feed cassette to the image forming portion.

If a length of the reference plate on the apparatus body side is shortened by shortening the sheet conveying distance from the sheet feed cassette to the image forming portion in the system of making the widthwise side edge of the sheet abut against the reference plate by obliquely feeding the sheet in particular, a small gap generated between the reference plane of the apparatus body and the reference plane of the sheet feed cassette may cause a negative influence on a skew correcting ability. However, in the configuration of forming the reference plane against which the widthwise side edge of the sheet abuts by making the reference plane provided in the sheet feed cassette with the reference plane provided in the apparatus body as described above, the small level difference is inherently generated due to its configuration.

That is, there is a problem that the small level difference between the reference planes of the apparatus body side and of the sheet feed cassette side degrades the skew correcting ability if the downsized and quick-printing speed image forming apparatus is to be provided.

SUMMARY OF THE INVENTION

According to one aspect of the invention, a sheet feeding apparatus includes an apparatus body, a sheet feed cassette provided attachably/drawably to/out of the apparatus body, a stacking member, provided in the sheet feed cassette, on which a sheet is stacked, a feed member feeding the sheet stacked on the stacking member in a condition in which the sheet feed cassette is attached at an attachment position of the apparatus body, a conveying member conveying the sheet fed by the feed member obliquely with respect to a feed direction in which the feed member feeds the sheet, and a conveyance guide member provided in the apparatus body and having a reference plane against which a side edge, in a width direction orthogonal to the feed direction, of the sheet obliquely conveyed by the conveying member abuts, the reference plane being provided upstream, in the feed direction, of a downstream end of the sheet stacked on the stacking member in a state in which the sheet feed cassette is attached to the attachment position of the apparatus body and is provided, in terms of a vertical direction, under an uppermost sheet stacked on the stacking member in the state in which the sheet feed cassette is attached to the attachment position of the apparatus body.

Further features of the present invention will become apparent from the following description of exemplary embodiments with reference to the attached drawings.

DESCRIPTION OF THE EMBODIMENTS

Preferable embodiments of the invention will be described in detail below with reference to the drawings. However, sizes, materials and shapes of components described in the following embodiments and their relative disposition are to be appropriately changed depending on a configuration of an apparatus to which the invention is applied and on various conditions. Accordingly, it should not be construed that a scope of the invention is limited to them unless described specifically.

First Embodiment

An image forming apparatus including a sheet feeding apparatus of a first embodiment will be described. While a copier, a printer, a facsimile, a multi-function printer, and the like may be cited as the image forming apparatus, the following embodiment will be described by exemplifying a laser beam printer as the image forming apparatus.

Here, an entire configuration and a printing process of the laser beam printer will be described at first in a sequence of the description. Then, a skew correcting operation of the sheet feeding apparatus will be described in detail, and a relationship between a sheet feed cassette and a reference plane in attaching/detaching the sheet feed cassette will be described at last.

Figure 1A:
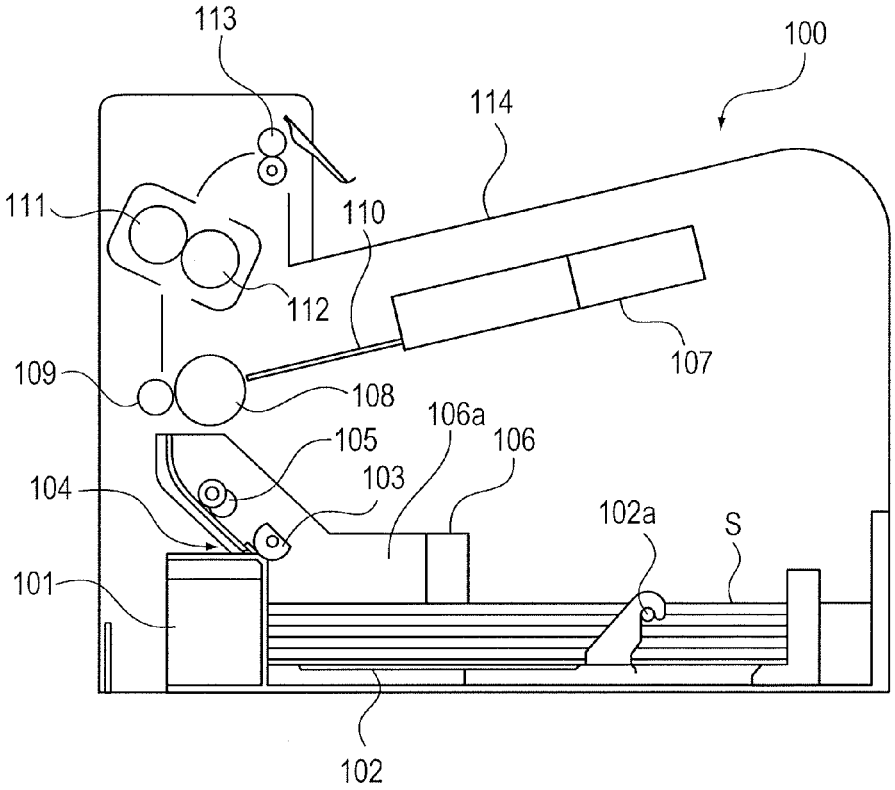
FIG. 1A is a section view schematically illustrating an entire configuration of a laser beam printer of a first embodiment.
Figure 1B:
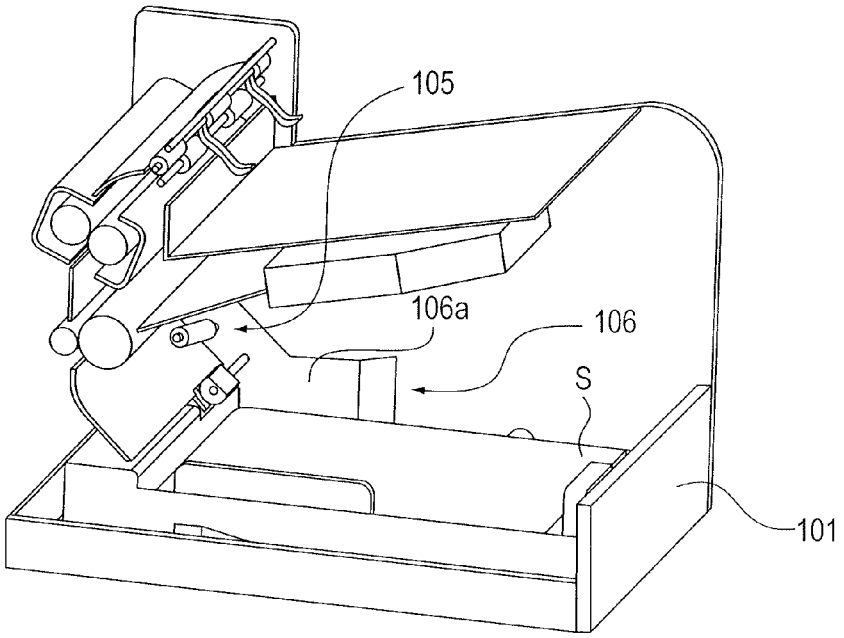
FIG. 1B is a perspective view schematically illustrating the entire configuration of the laser beam printer of the first embodiment.

The structure of the laser beam printer of the first embodiment will be schematically described with reference to FIGS. 1A and 1B. FIG. 1A is a section view schematically illustrating the entire configuration of the laser beam printer. FIG. 1B is a perspective view schematically illustrating the entire configuration of the laser beam printer. It is noted that components unnecessary for the description are not shown both in FIGS. 1A and 1B.

As shown in FIG. 1A, the laser beam printer 100 is configured to record an image on a sheet S based on electronic information. The printer 100 includes a sheet feed cassette 101 storing the sheet S, a conveying path for conveying the sheet S, an image forming portion forming an image, a fixing portion fixing the image, and others.

The sheet feed cassette 101 is provided to be attachable/drawable to/out of an apparatus body of the printer 100. The sheet feed cassette 101 is provided with an intermediate plate 102 lifting up the sheet to a sheet separating portion separating the sheet one by one. The intermediate plate 102 is provided within the sheet feed cassette 101 and functions as a stacking member on which the sheet is stacked. The sheet S is lifted up to the sheet separating portion by an operation of the intermediate plate 102 during a sheet feeding operation.

The sheet separating portion is composed of a feed roller 103 cut into a shape of D and a separation pad 104. The feed roller 103 is a feed member feeding the sheet S stacked on the intermediate plate 102. Then, the sheet S lifted up by the intermediate plate 102 is separated one by one by the feed roller 103 cut into the shape of D and the separation pad 104, i.e., the components composing the stacking member, and is fed to an oblique conveying roller 105. That is, the separation pad 104 is disposed so as to face the feed roller 103, i.e., the feed member, through the sheet S and separates an uppermost sheet S1 from a succeeding sheet by cooperating with the feed roller 103.

The oblique conveying roller 105 is a conveying member conveying the sheet, separated and fed one by one by the feed roller 103 and the separation pad 104, obliquely with respect to a feed direction in which the feed roller 103 feeds the sheet. The oblique conveying roller 105 abuts the sheet separated as described above against a reference plane 106*a* of a conveyance guide member 106 and sends the sheet, while correcting a skew, to the image forming portion. It is noted that the reference plane 106*a* of the conveyance guide member 106 will be described in detail later.

The image forming portion includes an exposure unit 107, a photosensitive drum 108, a transfer roller 109, a charging portion not shown, a developing portion not shown, and a cleaning portion not shown. The photosensitive drum 108 is composed of a metallic cylinder in which a photosensitive layer whose charging polarity is negative is formed on a surface thereof. The charging portion charges the surface of the photosensitive drum 108, i.e., an image bearing member, homogeneously. The exposure unit 107 irradiates a laser beam 110 on the photosensitive drum 108 and forms an electrostatic latent image thereon. The developing portion applies toner onto the electrostatic latent image to visualize as a toner image. The transfer roller 109 presses the sheet against the photosensitive drum 108 to transfer the toner image on the photosensitive drum 108 onto the sheet S.

A skew of the sheet sent to a nip portion (transfer portion) between the transfer roller 109 and the photosensitive drum 108 in the image forming portion described above has been corrected before the sheet arrives at the transfer portion because the widthwise side edge of the sheet has been made abut against the reference plane 106*a* by the oblique conveying roller 105 as described above. Therefore, the toner image is formed on a correct position on the sheet S.

It is noted that toner left on the surface of the photosensitive drum 108 after the transfer is removed by the cleaning portion. The sheet S on which the toner image has been transferred is sent to the fixing portion. The fixing portion includes a pressure roller 111 and a fixing roller 112 including a heater therein. The fixing portion applies heat and pressure to the sheet S passing there through to fix the transferred toner image onto the sheet S. Then, the sheet S is sent to a discharge roller pair 113 and is discharged to a discharge tray provided on a top cover of the apparatus.

The entire configuration and the printing process of the laser beam printer 100 have been described above.

Figure 2A:
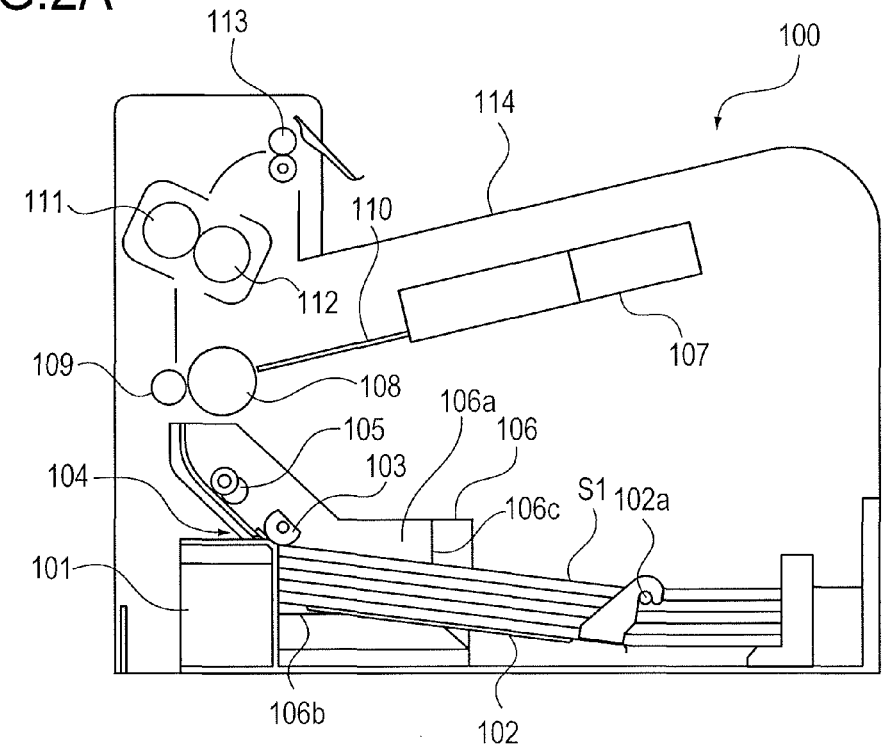
FIG. 2A is a section view illustrating the printer in which a sheet is lifted up.
Figure 2B:
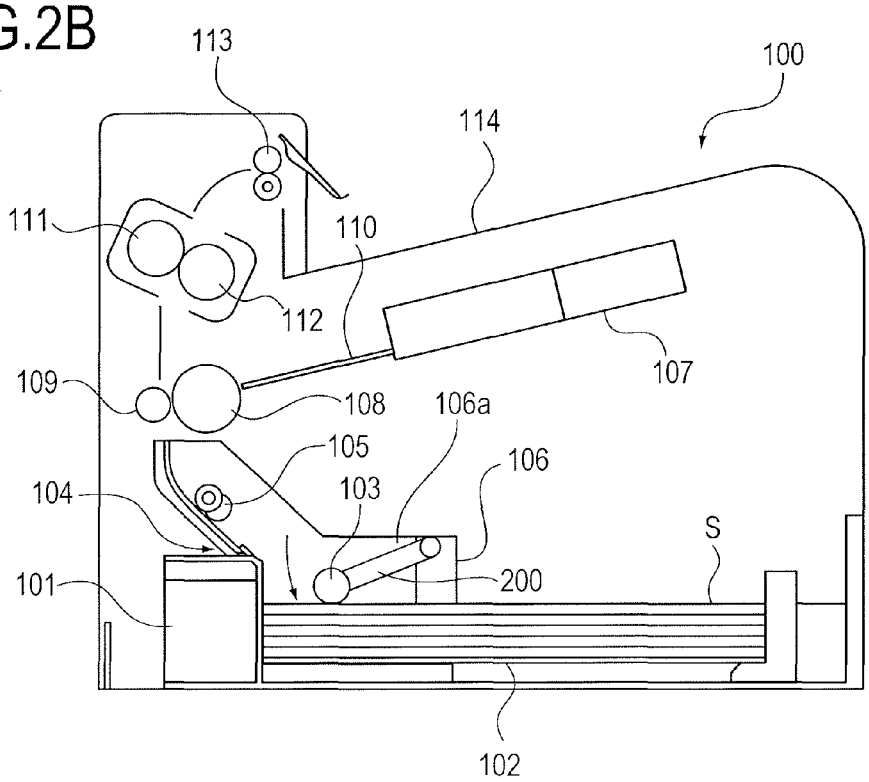
FIG. 2B is a section view of a printer configured not to lift up a sheet.

Next, the sheet skew correcting operation of the laser beam printer 100 will be described in detail with reference to FIGS. 2A and 2B. FIG. 2A is a section view illustrating the laser beam printer in a condition in which a sheet is lifted up and can be fed. FIG. 2B is a section view of the laser beam printer configured not to lift up a sheet.

As described above, the sheet S is lifted up to the sheet separating portion by the operation of the intermediate plate 102. The intermediate plate 102 is turned by a driving source not shown centering on a fulcrum point 102*a* provided in the sheet feed cassette 101. That is, as shown in FIG. 2A, the intermediate plate 102 is turnable centering on the fulcrum point 102*a* such that the uppermost sheet S1 stacked on the intermediate plate 102 comes into contact with the feed roller 103 in the state in which the sheet feed cassette 101 is attached to the attachment position of the apparatus body.

The conveyance guide member 106 is provided in the apparatus body of the printer 100. As shown in FIG. 2A, the reference plane 106*a* of the conveyance guide member 106 is a plane against which a widthwise side edge, orthogonal to the feed direction, of the sheet conveyed aslant by the oblique conveying roller 105 abuts. An upstream end portion 106*c* of the reference plane 106*a*, coplanar with the reference plane 106*a*, is provided upstream, in the feed direction, of a downstream end of the sheet S stacked on the intermediate plate 102 in the state in which the sheet feed cassette 101 is attached to the attachment position of the apparatus body. Still further, a lower end portion 106*b* of the reference plane 106*a*, coplanar with the reference plane 106*a*, is provided, in terms of a vertical direction, under the uppermost sheet S1 stacked on the intermediate plate 102 in the state in which the sheet feed cassette 101 is attached to the attachment position of the apparatus body.

More specifically, as shown in FIG. 2A, in terms of the vertical direction, the reference plane 106*a* is provided under the uppermost sheet S1 stacked on the intermediate plate 102 in the state in which the uppermost sheet S1 stacked on the intermediate plate 102 is in contact with the feed roller 103 in the present embodiment. This arrangement makes it possible to increase a contact distance with the reference plane 106*a* during when the sheet S is conveyed from the sheet feed cassette 101 to the photosensitive drum 108. Therefore, it is possible to keep the sheet skew correcting ability even in the configuration in which the sheet conveying distance from the sheet feed cassette 101 is shortened.

It is noted that while the configuration in which the sheet is lifted up by the intermediate plate 102 has been exemplified in the present embodiment, the present invention is not limited to such configuration. For instance, the configuration of the invention is effective also in a configuration not requiring lifting up a sheet. The configuration may be one in which the feed roller 103 can be moved by a link mechanism 200 so as to be in contact with the uppermost sheet S1 stacked on the intermediate plate 102 as shown in FIG. 2B. It is possible to adapt the embodiment described above also in this configuration. The same effect can be obtained also in this case as long as the lower end portion 106*b* of the reference plane 106*a* is provided, in terms of the vertical direction, under the uppermost sheet S1 to be fed.

The sheet separating portion of the printer 100 shown in FIG. 1A separates the sheet S stored in the sheet feed cassette 101 one by one by the feed roller 103 cut into the shape of D and the separation pad 104 of the sheet separating portion and feeds the sheet S to the oblique conveying roller 105. The oblique conveying roller 105 is inclined with respect to the reference plane 106*a* such that the conveying roller 105 conveys the sheet so as to make the sheet abut against the reference plane 106*a* of the conveyance guide member 106 as shown in FIG. 1B. Due to that, the fed sheet S is moved by the oblique conveying roller 105 toward the reference plane 106*a* while being conveyed to the image forming portion.

It is noted that at this time, the feed roller 103 rotates and the D-cut portion thereof faces to a surface side of the separation pad 104. Therefore, the separation pad 104 and the D-cut portion of the feed roller 103 do not nip the sheet S, and the sheet S becomes movable to the reference plane 106*a* by the oblique conveying roller 105.

Then, the widthwise one side edge of the sheet S separately fed abuts against the reference plane 106*a*, so that the oblique conveying roller 105 can feed the sheet S to the image forming portion while correcting a skew of the sheet S.

It is noted that the reference plane 106*a* of the conveyance guide member 106 provided in the apparatus body extends across the sheet feed cassette in the present embodiment. Specifically, the lower end portion 106*b* of the reference plane 106*a* provided on the apparatus body side is located under the uppermost sheet 51 in the sheet feed cassette 101 in this configuration as described above. Therefore, as compared to a conventional configuration in which a difference of level is generated between the apparatus body and the sheet feed cassette, no difference of level is generated between the components in the reference plane 106*a* of this configuration, so that it is possible to correct the skew of the sheet more accurately.

Figure 3A:
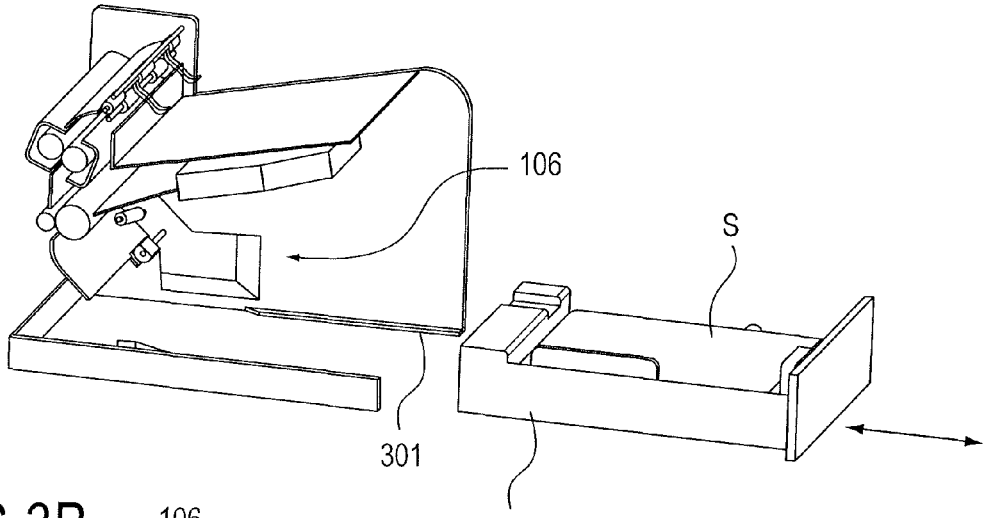
FIG. 3A is perspective view schematically illustrating a state in which a sheet feed cassette is drawn out of a body of the printer.
Figure 3B:
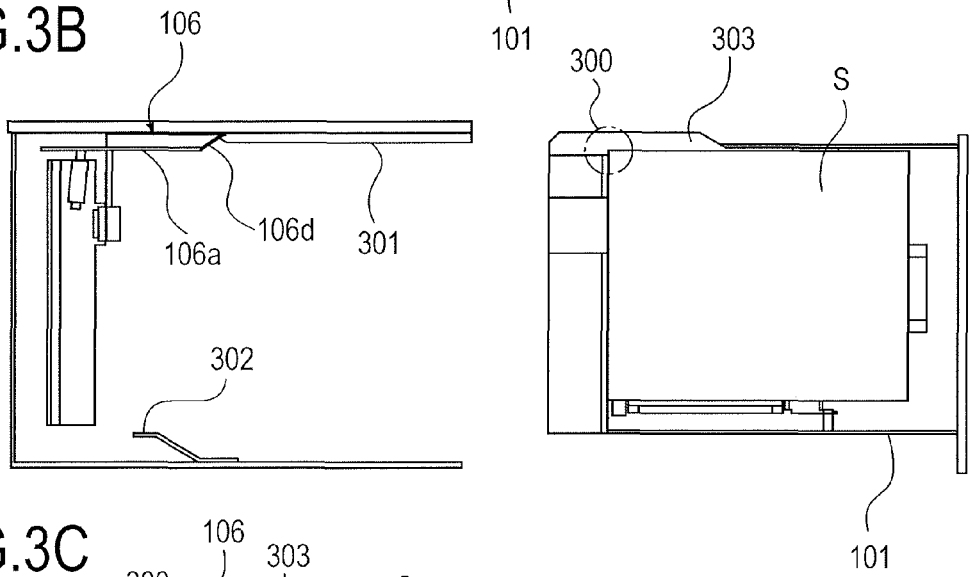
FIG. 3B is a plane section view of FIG. 3A.
Figure 3C:
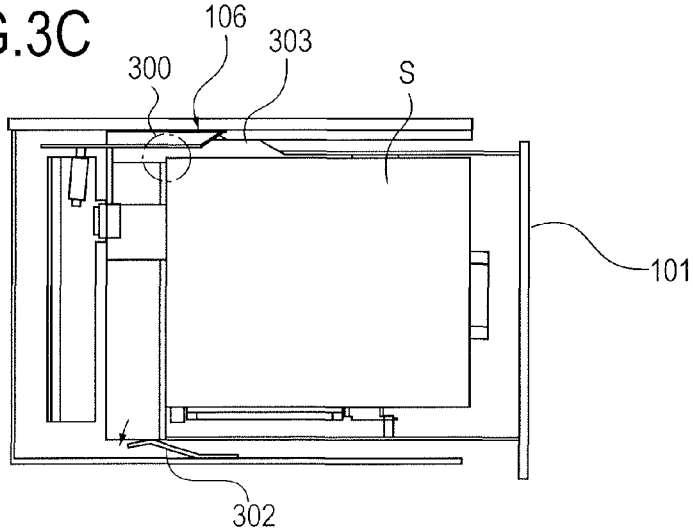
FIG. 3C is a plane section view schematically illustrating a state in which the sheet feed cassette is being attached.

Next, a relationship between the sheet feed cassette and the reference plane in attaching/detaching the sheet feed cassette will be described with reference to FIGS. 3A through 3C. FIG. 3A is a perspective view schematically illustrating a state in which the sheet feed cassette is drawn out of the printer body. FIG. 3B is a plane section view schematically illustrating the printer and the sheet feed cassette in the condition shown in FIG. 3A. FIG. 3C is a plane section view schematically illustrating a state in which the sheet feed cassette is being attached.

As shown in FIGS. 3A and 3B, an end portion 300 of the sheet S is exposed out of the sheet feed cassette in attaching/detaching the sheet feed cassette 101 to/from the apparatus body. The conveyance guide member 106 is provided with a tapered surface 106*d* for introducing the sheet upstream, in the feed direction, of the reference plane 106*a* with respect to a direction in which the sheet feed cassette is inserted. This arrangement makes it possible to smoothly insert the sheet feed cassette 101 even if the end portion 300 of the sheet S is out of the sheet feed cassette 101 as described above.

Still further, the apparatus body is provided with a rail 301, i.e., a guide member, guiding the sheet feed cassette 101 in attaching/drawing to/out of the apparatus body and a pressure spring 302, i.e., a bias member, pressing the sheet feed cassette 101 to the rail 301. The rail 301 is provided on a reference plane side in the sheet width direction and the pressure spring 302 is provided on a side opposite to the reference plane in the sheet width direction. Still further, a cassette-side guide 303 corresponding to the rail 301 is provided on the sheet feed cassette 101 side. The cassette-side guide 303 is a guided member guided by the rail 301. This arrangement makes it possible to insert the sheet feed cassette 101 into the apparatus body in a condition in which the end portion 300 of the sheet S being out of the sheet feed cassette 101 is kept away from the end portion of the reference plane 106*a* and in which the widthwise side edge on the side of the reference plane of the sheet S approaches to the reference plane. Therefore, it is possible to insert the sheet feed cassette 101 into the apparatus body without bending the end portion of the sheet S being out of the sheet feed cassette 101.

As described above, according to the present embodiment, it is possible to keep the sheet skew correcting ability while attaining the downsized and quick-printing speed image forming apparatus.

Second Embodiment

An image forming apparatus including a sheet feeding apparatus of a second embodiment shown in FIGS. 4A and 4B and FIGS. 5A and 5B is different from that of the first embodiment in terms of a direction in which the sheet feed cassette is attached/drawn out and of a configuration of a reference plane of the apparatus body. Therefore, an entire configuration of the image forming apparatus, other those described above, is the same with that of the first embodiment described above, so that the same or corresponding components with those of the first embodiment will be denoted by the same reference numerals and an overlapped detailed explanation thereof will be omitted.

Figure 4A:
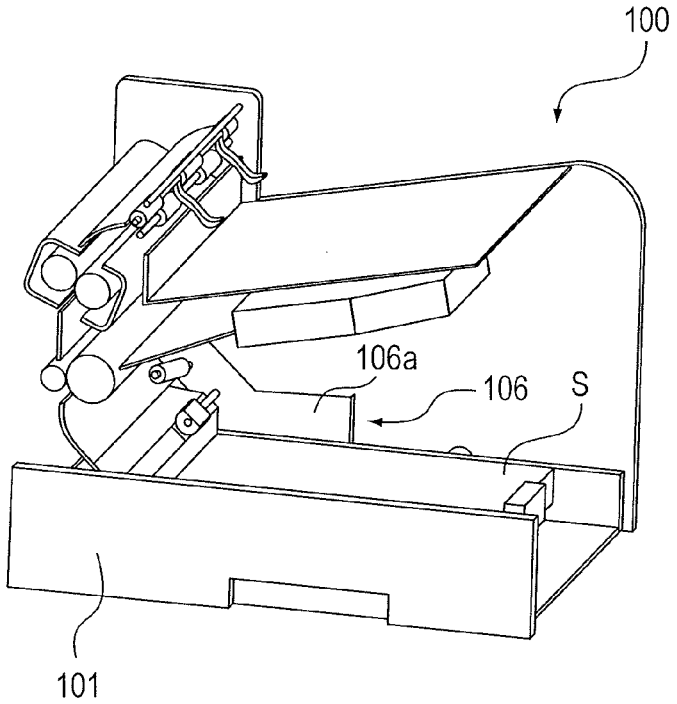
FIG. 4A is a perspective view schematically illustrating an entire configuration of a laser beam printer of a second embodiment.
Figure 4B:
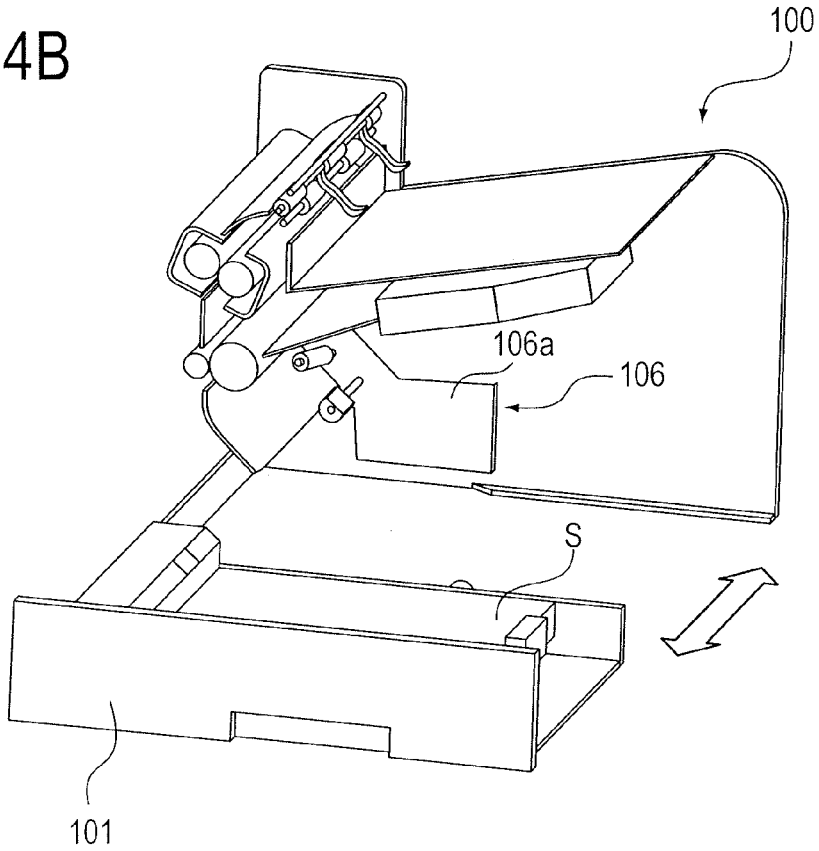
FIG. 4B is a perspective view illustrating a state in which the cassette is drawn out of the body of the laser beam printer.

The image forming apparatus of the second embodiment will be described with reference to FIGS. 4A and 4B. FIG. 4A is a perspective view schematically illustrating an entire configuration of the image forming apparatus of the second embodiment. FIG. 4B is a perspective view illustrating a state in which a sheet feed cassette is drawn out of an apparatus body of the image forming apparatus of the second embodiment.

According to the second embodiment, the sheet feed cassette 101 is provided to be able to be attached to and drawn out of the apparatus body in the width direction orthogonal to the sheet feeding direction. That is, the direction in which the sheet feed cassette 101 is attached to/drawn out of the apparatus body is configured to be a vertical direction (direction of an arrow in FIG. 4B) with respect to the reference plane 106*a* of the conveyance guide member 106. This arrangement makes it possible to insert the sheet feed cassette without bending a sheet end portion because the widthwise sheet edge of the sheet stored in the sheet feed cassette approaches to the reference plane 106*a*.

Figure 5A:
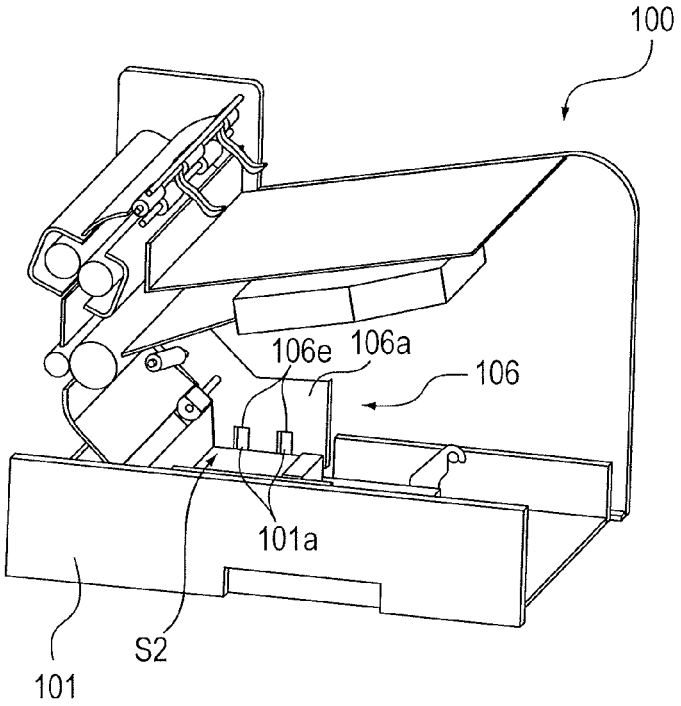
FIG. 5A is a perspective view illustrating a state in which a sheet feed cassette corresponding to a small-size sheet is attached.
Figure 5B:
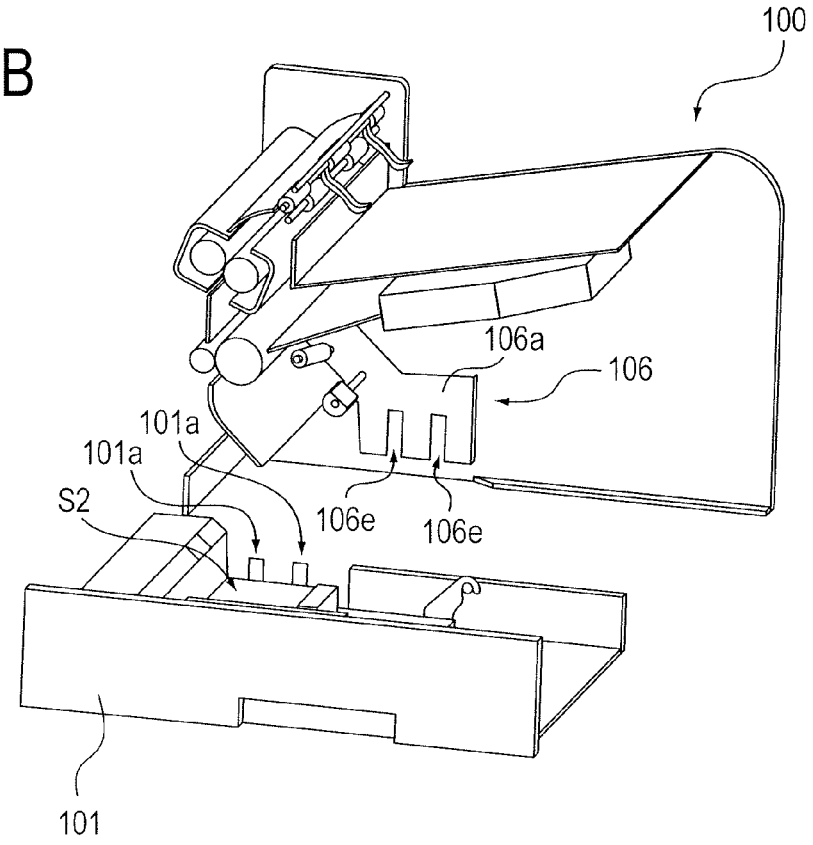
FIG. 5B is a perspective view illustrating a state in which the sheet feed cassette corresponding to the small-size sheet is drawn out.

Still further, in addition to the construction described above, the sheet feed cassette may be one accommodating a small-size sheet as shown in FIGS. 5A and 5B. FIG. 5A is a perspective view illustrating a state in which a sheet feed cassette accommodating the small-size sheet is attached. FIG. 5B is a perspective view illustrating a state in which the sheet feed cassette accommodating the small-size sheet is drawn out.

As shown in FIGS. 5A and 5B, a notch 106*e* is provided on the reference plane 106*a* of the conveyance guide member 106 of the apparatus body, and a vertical wall 101*a* restricting the sheet widthwise edge is provided at a position corresponding to the notch 106*e* of the sheet feed cassette 101. Thereby, even if a small-size sheet S2 is stored in the sheet feed cassette 101, the sheet S2 will not fall out of the sheet feed cassette 101 even if the sheet feed cassette 101 is inclined.

Still further, the vertical wall 101*a* is preferable to be disposed slightly rearward, in an attaching direction, of the reference plane 106*a* when the sheet feed cassette is located at the attachment position (position shown in FIG. 5A). This arrangement makes it possible to reliably abut the sheet widthwise side edge against the reference plane 106*a*.

It is possible to keep the sheet skew correcting ability while attaining the downsized and improved printing speed similarly to the first embodiment even if the apparatus body is constructed as described above.

Other Embodiment

It is noted that while the printer has been exemplified as the image forming apparatus in the embodiment described above, the present invention is not limited to the printer. For instance, the image forming apparatus maybe another image forming apparatus such as a copier, a facsimile machine, a multi-function printer in which their functions are combined, and others. It is possible to obtain the same advantageous effect by applying the present invention to the sheet feeding apparatus of those image forming apparatuses.

Still further, while the sheet feeding apparatus integrated with the image forming apparatus has been exemplified in the embodiment described above, the present invention is not limited to such sheet feeding apparatus. For instance, the sheet feeding apparatus may be one removable from an image forming apparatus, and it is possible to obtain the same advantageous effect by applying the present invention to the sheet feeding apparatus.

Still further, while the sheet feeding apparatus feeding a sheet such as a recording sheet, i.e., a recording target, has been exemplified in the embodiment described above, the present invention is not limited to that. For instance, it is possible to obtained the same advantageous effect by applying the present invention to the sheet feeding apparatus feeding a sheet such as a document as a reading target.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-212434, filed Oct. 17, 2014, which is hereby incorporated by reference herein in its entirety.

What is claimed is:

1. A sheet feeding apparatus, comprising:

an apparatus body;

a sheet feed cassette provided attachably/drawably to/out of the apparatus body;

a stacking member, provided in the sheet feed cassette, on which a sheet is stacked;

a feed member configured to feed the sheet stacked on the stacking member in a condition in which the sheet feed cassette is attached at an attachment position of the apparatus body;

a conveying member configured to convey the sheet fed by the feed member obliquely with respect to a feed direction in which the feed member feeds the sheet; and a conveyance guide member provided in the apparatus body and having a reference plane against which a side edge, in a width direction orthogonal to the feed direction, of the sheet obliquely conveyed by the conveying member abuts, the reference plane being provided upstream, in the feed direction, of a downstream end of the sheet stacked on the stacking member in a state in which the sheet feed cassette is attached to the attachment position of the apparatus body and is provided, in terms of a vertical direction, under an uppermost sheet stacked on the stacking member in the state in which the sheet feed cassette is attached to the attachment position of the apparatus body, wherein the sheet feed cassette is provided so as to be attachable/drawable in the width direction orthogonal to the feeding direction, and wherein a notch is provided on the reference plane and a vertical wall restricting a widthwise end portion of the sheet is provided at a position coincident with the notch.

2. The sheet feeding apparatus according to claim 1, wherein the stacking member is movable such that the sheet stacked on the stacking member comes into contact with the feed member, and wherein the reference plane is provided, in terms of a vertical direction, under an uppermost sheet stacked on the stacking member in a state in which the sheet stacked on the stacking member is in contact with the feed member.

3. The sheet feeding apparatus according to claim 1, wherein the feed member is movable so as to be in contact with a sheet stacked on the stacking member, and wherein the reference plane is provided, in terms of a vertical direction, under an uppermost sheet stacked on the stacking member in a state in which the feed member is in contact with a sheet stacked on the stacking member.

4. The sheet feeding apparatus according to claim 1, wherein the vertical wall is disposed on a rear side in an attachment direction of the reference plane in a state in which the sheet feed cassette is attached to the attachment position of the apparatus body.

5. The sheet feeding apparatus according to claim 1, further comprising: a separation pad disposed so as to face the feed member through the sheet and separating an uppermost sheet from a succeeding sheet by cooperating with the feed member.

6. An image forming apparatus, comprising:

an apparatus body;

a sheet feed cassette provided attachably/drawably to/out of the apparatus body;

a stacking member, provided in the sheet feed cassette, on which a sheet is stacked;

an image forming portion configured to form an image on the sheet;

a feed member configured to feed the sheet stacked on the stacking member to the image forming portion in a condition in which the sheet feed cassette is attached at an attachment position of the apparatus body;

a conveying member configured to convey the sheet fed by the feed member obliquely with respect to a feed direction in which the feed member feeds the sheet; and a conveyance guide member provided in the apparatus body and having a reference plane against which a side edge, in a width direction orthogonal to the feed direction, of the sheet obliquely conveyed by the conveying member abuts, the reference plane being provided upstream, in the feed direction, of a downstream end of the sheet stacked on the stacking member in a state in which the sheet feed cassette is attached to the attachment position of the apparatus body and is provided, in terms of a vertical direction, under an uppermost sheet stacked on the stacking member in the state in which the sheet feed cassette is attached to the attachment position of the apparatus body, wherein the sheet feed cassette is provided so as to be attachable/drawable in the width direction orthogonal to the feeding direction and wherein a notch is provided on the reference plane and a vertical wall restricting a widthwise end portion of the sheet is provided at a position coincident with the notch.

* * * * *